US005290032A

United States Patent [19]

Fenton et al.

[11] Patent Number: 5,290,032

[45] Date of Patent: Mar. 1, 1994

[54] IRON WITH PROGESSIVE BACK CAVITY SUPPORT BAR

[75] Inventors: Frank Fenton, South Hadley; Thomas M. Greene, Monson, both of Mass.

[73] Assignee: Lisco, Inc., Tampa, Fla.

[21] Appl. No.: 505,114

[22] Filed: Apr. 2, 1990

[51] Int. Cl.[5] ..... A63B 53/04

[52] U.S. Cl. ..... 273/77 A; 273/169; 273/167 F

[58] Field of Search ..... 273/77 R, 77 A, 167 R, 273/167 D, 167 F, 169

[56] References Cited

U.S. PATENT DOCUMENTS

| | | | |
|---|---|---|---|
| D. 137,816 | 5/1944 | Newsome | D34/5 |
| D. 164,596 | 9/1951 | Penna | D34/5 |
| D. 164,597 | 9/1951 | Penna | D34/5 |
| D. 234,963 | 4/1975 | Hirata | D34/5 GH |
| D. 265,494 | 7/1982 | Kobayashi | D21/220 |
| D. 268,775 | 4/1983 | Pace | D21/220 |
| D. 304,485 | 11/1989 | Long | D21/220 |
| 3,059,926 | 10/1962 | Johnstone | 273/167 R |
| 3,814,437 | 6/1974 | Winquist | 273/167 R |
| 3,847,399 | 11/1974 | Raymont | 273/167 F |
| 3,955,820 | 5/1976 | Cochran et al. | 273/167 F |
| 3,995,864 | 12/1976 | Cochran et al. | 273/164 |
| 3,995,865 | 12/1976 | Cochran et al. | 273/167 F |
| 4,420,156 | 12/1983 | Campau | 273/77 A |
| 4,715,601 | 12/1987 | Lamanna | 273/77 A |
| 4,802,672 | 2/1989 | Long | 273/77 A |
| 4,826,172 | 5/1989 | Antonious | 273/169 |
| 4,854,581 | 8/1989 | Long | 273/77 A |
| 4,858,929 | 8/1989 | Long | 273/77 A |
| 4,883,274 | 11/1989 | Hsien | 273/164 |
| 4,921,252 | 5/1990 | Antonious | 273/169 |

*Primary Examiner*—Vincent Millin
*Assistant Examiner*—William M. Pierce
*Attorney, Agent, or Firm*—Donald R. Bahr; John E. Benoit

[57] ABSTRACT

A set of golf club irons, each iron including a striking face, a cavity in the back of the club, and a vibration dampening support bar extending between the lower and upper edges and within the cavity. The distance between the center of the support bar to the end of the cavity at the heel of the iron decreases from the less-lofted irons through the more lofted irons. The center of gravity of all of the clubs is substantially at the center of the striking face of the club.

5 Claims, 4 Drawing Sheets

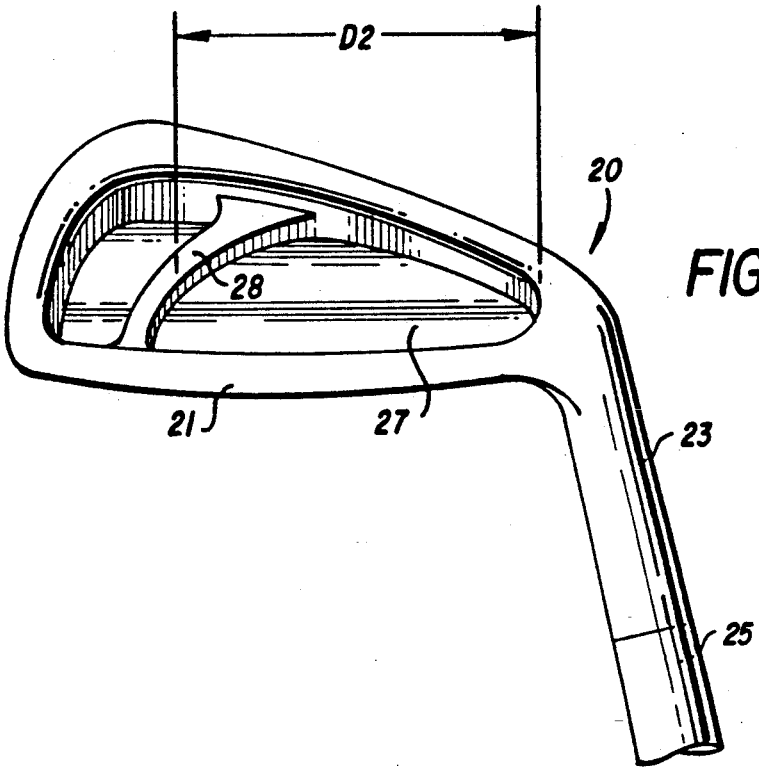
FIG. 1
FIG. 3
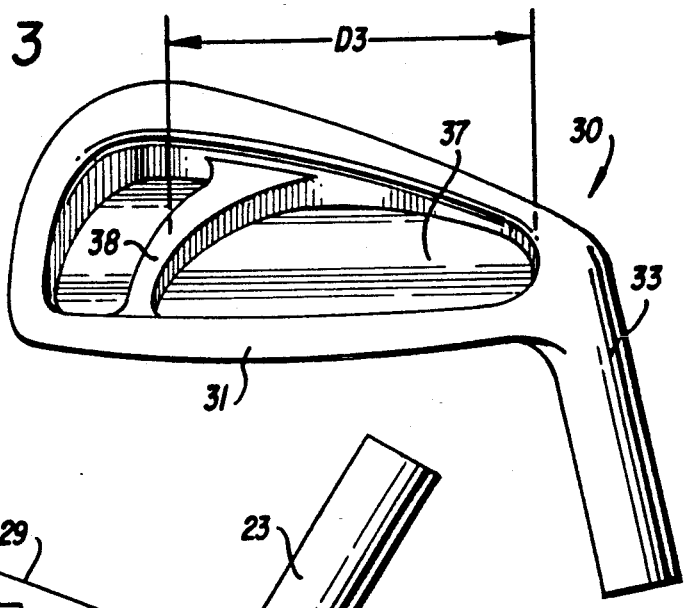
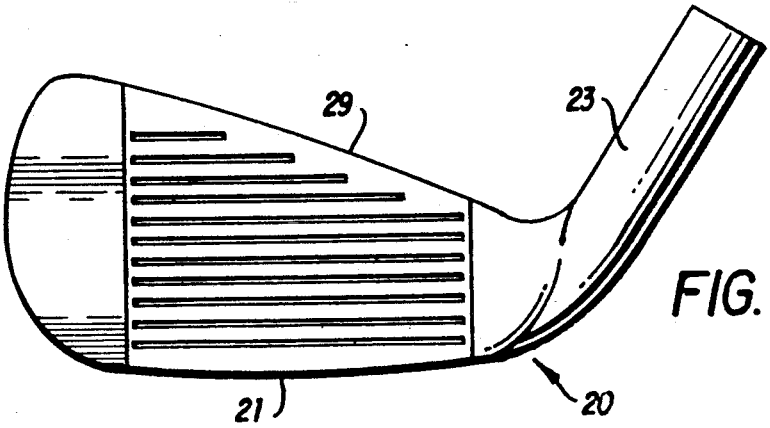
FIG. 2

IRON WITH PROGESSIVE BACK CAVITY SUPPORT BAR

This invention relates to golf clubs of the iron type and, more particularly, to golf clubs having cavities within the back thereof.

One of the types of golf clubs used today includes irons which have what is termed a "cavity back" wherein the back, or the side opposite the striking face of the iron, includes a substantially depessed area or cavity in the club. This particular design results in a relatively thin face when compared to the thicker-faced traditionally designed irons.

It has been observed that if golfers mishit an iron shot, they generally tend to mishit the difficult-to-use longer irons more toward the toe of the club face than they do the more easily handled short irons.

It has also been noted that cavity back irons produce a less solid feel due to the thin face design when compared to the thicker-faced traditionally designed irons.

It is desirable to maintain the center of gravity of each club in the approximate center of the club striking face for maximum transfer of energy to the ball from a shot well struck in this area. While this is a desirable attribute of the clubs, it was found that there was a need to limit the harsh vibration which would occur off the center of gravity when the shots are mishit, particularly toward the toe.

The present invention provides a cavity back design in a set of golf clubs with the addition of a vibration dampening support bar located within the cavity of each of the irons. This support bar assists in dampening the harsh feel of a golf shot when mishit, but still maintains the center of gravity of the club substantially at the center of the striking face.

This and other objects of the invention will become apparent from the following description taken together with the drawings.

SUMMARY OF THE INVENTION

The present invention relates to a set of golf club irons, with each iron including a striking face, a cavity in the back of the club, and a vibration dampening support bar extending between the lower and upper edges of the cavity. The distance between the center of the support bar to the end of the cavity at the heel of the iron decreases from the less-lofted irons through the more lofted irons. The center of gravity of all the clubs is substantially at the center of the striking face of each of the clubs.

BRIEF DESCRIPTION OF THE DRAWINGS

FIG. 1 is a side elevational view of the back of a 2-iron, including the present invention;

FIG. 2 is a side elevational view of the front striking face of the 2-iron of FIG. 1;

FIGS. 3–10 are side elevational views of golf club irons 3 through the pitching wedge in numerical sequence.

DETAILED DESCRIPTION OF THE PREFERRED EMBODIMENT

Figure 4:
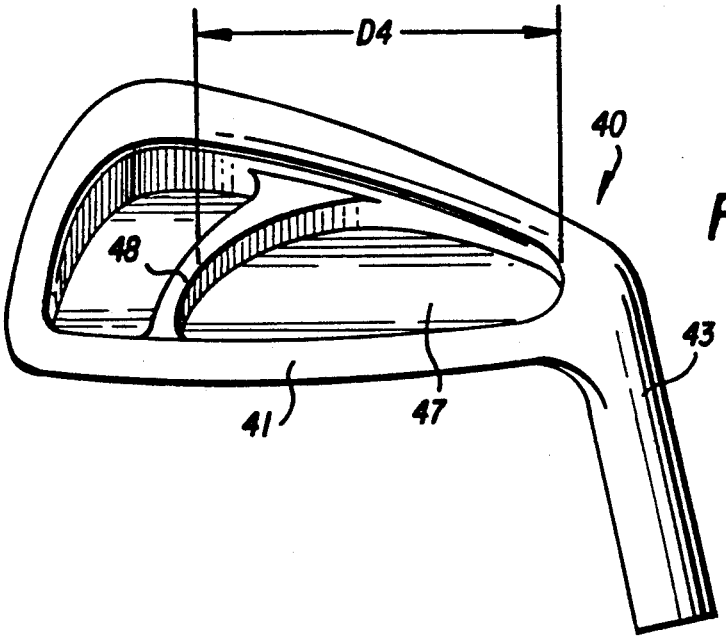

Referring to FIG. 1, there is shown 2-iron 20 having back face 21, hosel 23, and shaft 25. Back face 21 includes cavity 27, which contains therein vibration dampening support bar 28. In this instance, support bar 28 is shown having an arcuate configuration wherein the end of support bar 28 at the top of the cavity is closer to the toe end of the club than is the other end of the support bar terminating at the bottom of the cavity. The iron is preferably made of a one-piece casting.

Since the invention pertains to the distance between the center of support bar 28 and the end of the cavity nearest the heel of club 20, this distance has been designated in FIG. 1 as D2.

FIG. 2 is an illustration of the club head of FIG. 1 showing a standard grooved striking face 29. The subsequent illustration of the clubs in the set do not show the face side of the club since the face is a standard striking face including grooves and is not part of the present invention. Further, for purposes of clarity, the shaft is not shown in subsequent drawings.

FIG. 3 shows a side elevational view of 3-iron 30 having back face 31, hosel 33, cavity 37, and vibration dampening support bar 38. Again, the distance between the center of the support bar and the back of the cavity near the heel of club 30 is designated as D3.

FIG. 4 discloses an elevational view of the back of 4-iron 40 of the set having back face 41, hosel 43, cavity 47, and dampening support bar 48. Again, the distance between the center of support bar 48 and the back of the cavity near the heel of club 40 is indicated as D4.

Figure 5:
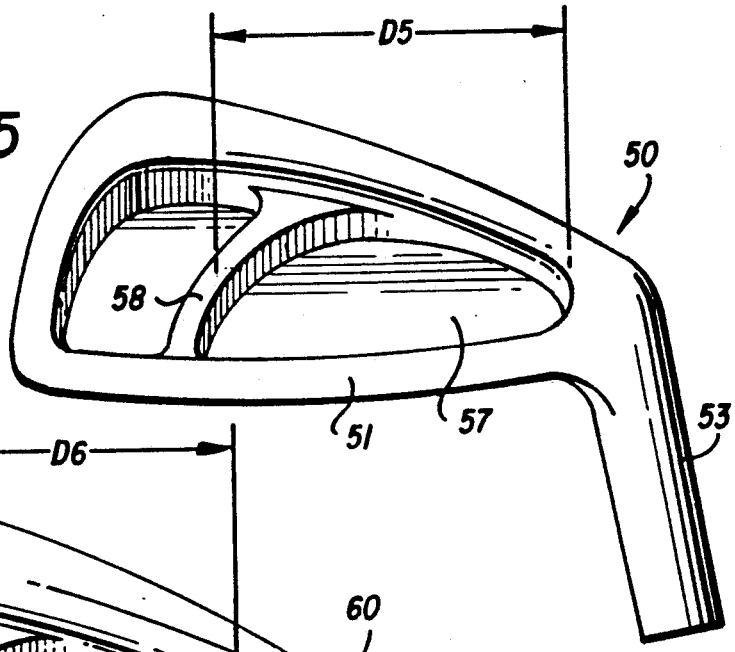

FIG. 5 is a side elevational view of the back of 5-iron 50 having back face 51, hosel 53, cavity 57, and dampening support bar 58. The distance discussed above is designated as D5.

Figure 6:
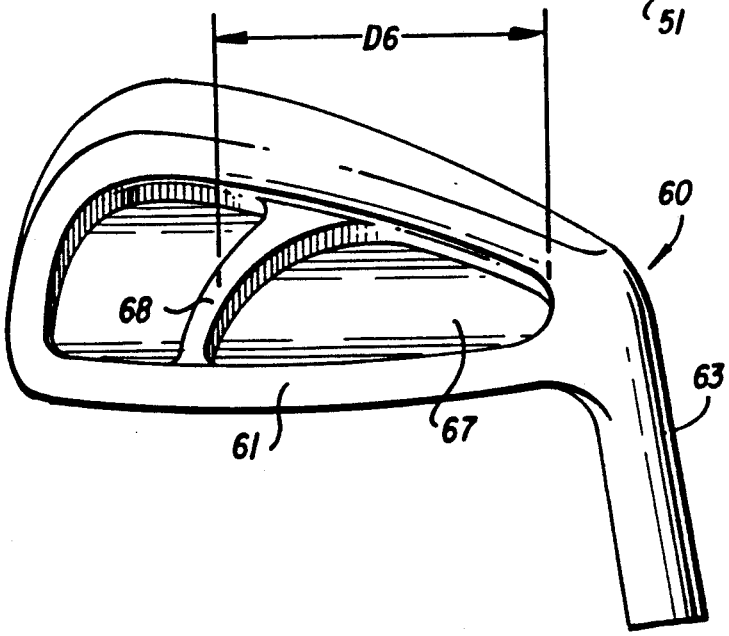

FIG. 6 is a side elevational view of the back of 6-iron 60 having back face 61, hosel 63, cavity 67, and dampening support bar 68. Again, the above-referred to dimension is designated as D6.

Figure 7:
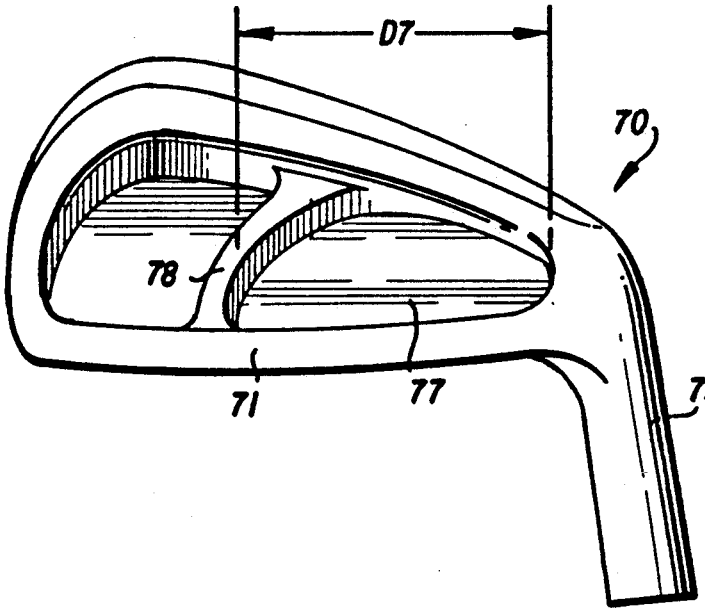

FIG. 7 is a side elevational view of 7-iron 70 having back face 71, hosel 73, cavity 77, and dampening support bar 78. The dimension discussed above is designated D7.

Figure 8:
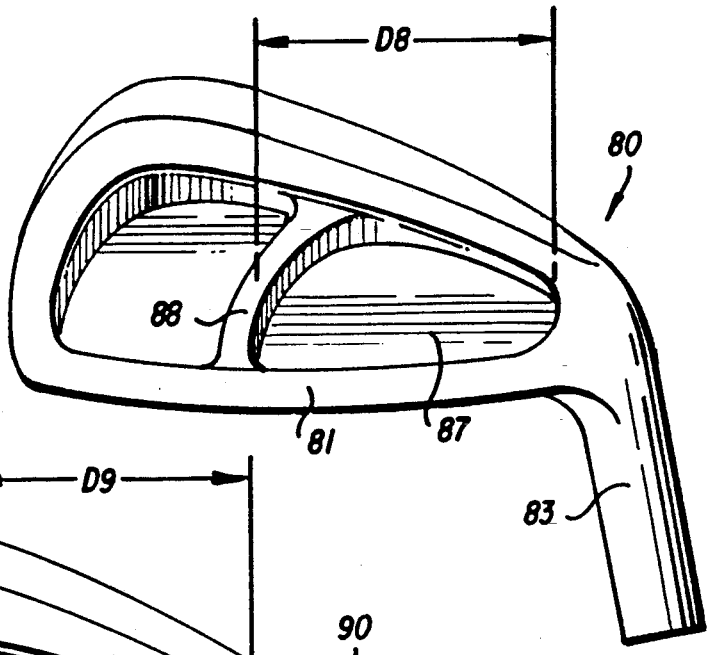

FIG. 8 discloses 8-iron 80 having back face 81, hosel 83, cavity 87, and dampening support bar 88, with the dimension discussed above designated D8.

Figure 9:
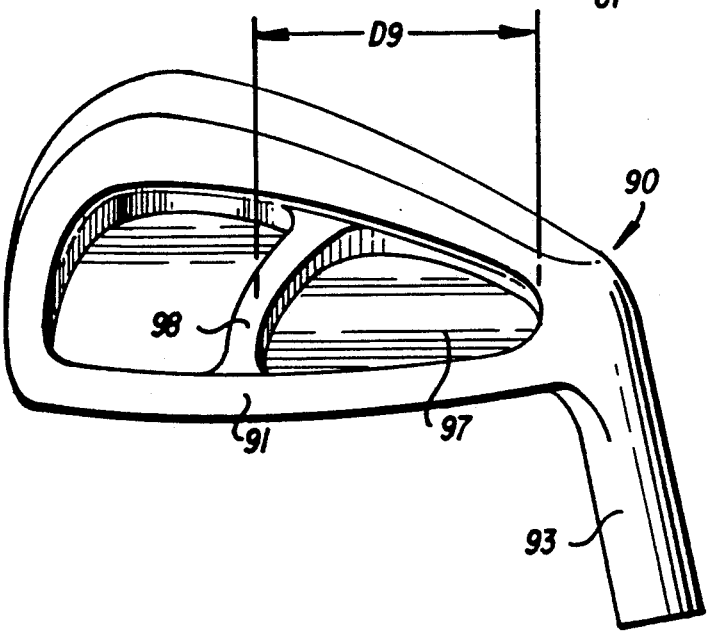

FIG. 9 discloses 9-iron 90 having back face 91, hosel 93, cavity 97, and dampening support bar 98. The dimension of importance is designated D9.

Figure 10:
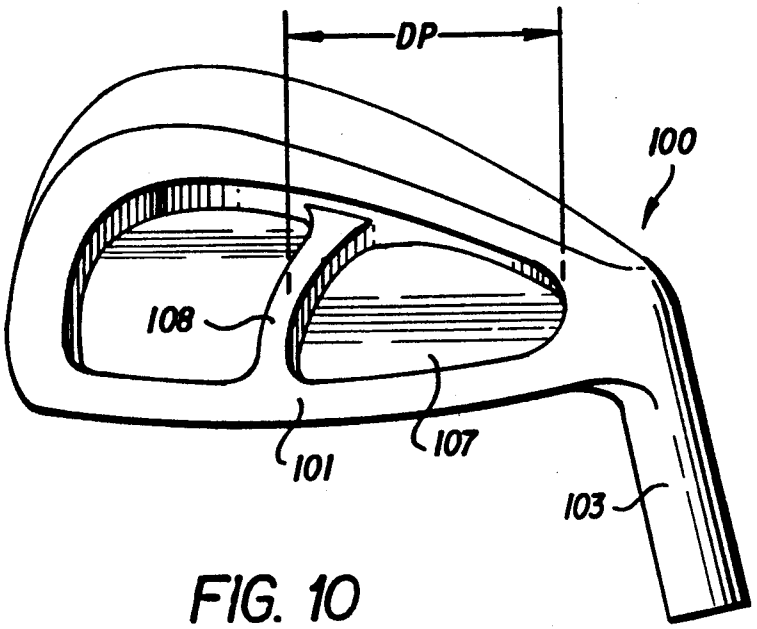

FIG. 10 is a side elevational view of pitching wedge 100 having back face 101, hosel 103, cavity 107, and dampening support bar 108, with the particular dimension of importance designated as DP.

Figure 11:
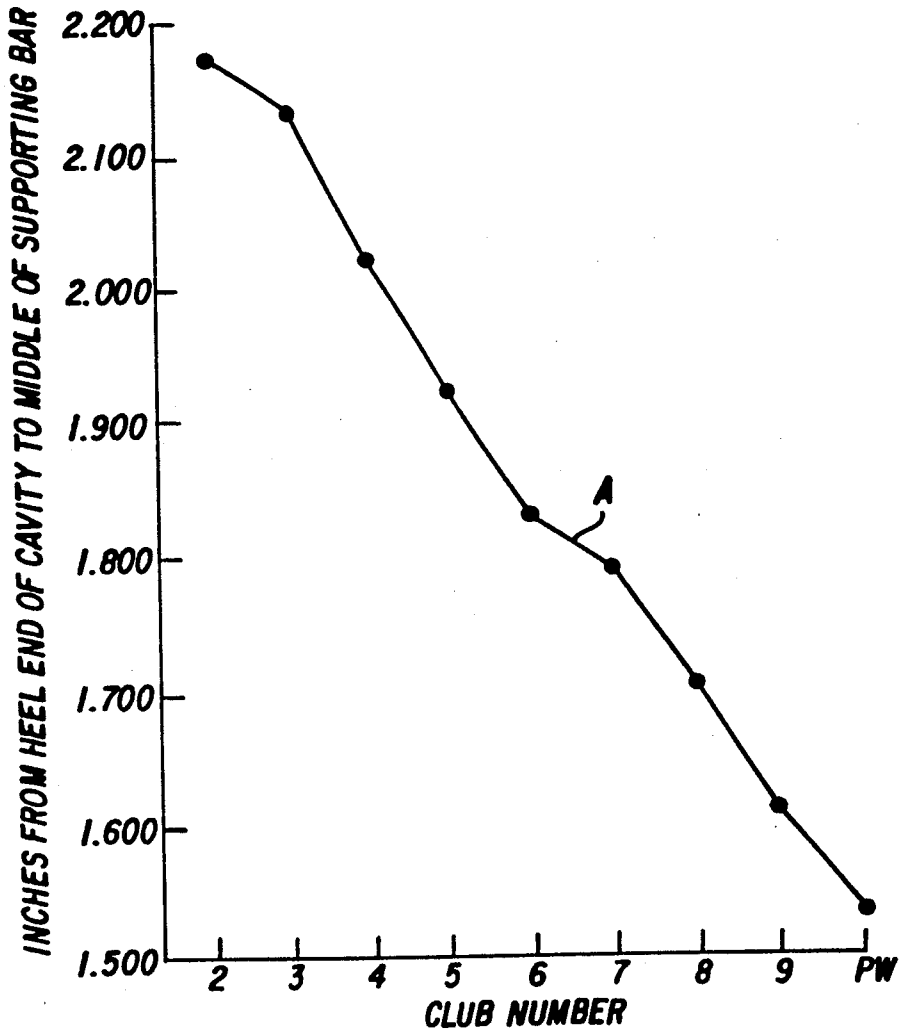
FIG. 11 is a graphical representation of an actual set of irons.

FIG. 11 is a graphical representation of the distances D2 through DP, as discussed above. The graph illustrates the following relationship:

$$D2>D3>D4>D5>D6>D7>D8>D9>DP$$

Preferably, the distance between the back of the cavity and the center of the dampening support bar progresses from 1.500 inches to 2.200 inches.

There might be some variations of the location of the center of the dampening support bar as long as the distance D decreases as the loft of the irons increases. An actual measurement of a club set developed the measurements as shown along solid line A.

It is important to note that the bars progressively move from the far toe location as shown in FIG. 2 on the long (less lofted) irons to the general toe location on the mid-irons, and finally move toward the middle location on the short (more lofted) irons. In all cases, the center of mass, or center of gravity, is located substantially in the middle of the club striking face and is not in alignment with the supporting bars. This center of gravity is maintained by varying the face thickness along the length of the blade for each of the irons.

The clubs of the present invention provide the feeling of a substantially solid hit by limiting the harsh vibration which would occur off the center of gravity when shots are mishit, particularly toward the toe of an iron having a back cavity.

It should be noted that although the dampening support bars are shown as having an arcuate configuration with the upper end of the bar being closer to the toe, the results desired could also be accomplished by having a substantially straight inclined dampening support bar.

The above description and drawings are illustrative, only, since modifications could occur without departing from the invention, the scope of which is to be limited only by the following claims.

We claim:

1. A set of golf club irons including at least a first and second iron, each of said irons comprising a shaft;

a head having a toe end and a heel end, said head being attached to one end of said shaft, said head comprising a substantially planar striking face and a back portion opposite said striking face;

a cavity in said back portion of said head, said cavity extending substantially between said toe end and said heel end of said head and having upper and lower edges;

a vibration dampening support bar within said cavity intermediate the toe end and heel end of said cavity and extending between said upper and lower edges of said cavity;

the center of said support bar in said cavity in said head of said first iron being a greater distance from the end of the cavity nearest the heel end than the distance between the center of the support bar in the cavity in the head of said second iron and the end of the cavity nearest the heel end;

the planar striking face of said head of said second iron having a greater degree of loft than the planar striking face of said head of said first iron; and the center of gravity of both of said first and second heads being substantially in the middle of said planar striking face of said first and second heads.

2. The golf club irons of claim 1 further including a plurality of said irons, each iron including said head having said striking face, cavity, and vibration dampening support bar;

the center of said vibration dampening support bars in said cavities being progressively closer to the end of the cavity nearest the heel end of said cavity as the degree of loft of said striking faces increases; and the center of gravity of each of said heads being at substantially the middle of said striking face of each said heads.

3. The golf club irons of claim 2 wherein the distance between the end of the cavities nearest the heel end and the center of the dampening support bars progresses for each each portion from 1.500 inches to 2.200 inches as the degree of loft in said striking face decreases.

4. The golf club irons of claim 1 wherein said dampening support bars are arcuate, with the end of the bar at said upper edge of said cavity being closer to the end of the cavity nearest the toe of said head than the end of the bars at said lower edge of said cavity.

5. The gold club irons of claim 1 wherein said heads of said irons, including said planar striking face, cavity and support bar, are cast as an integral one-piece unit.

* * * * *